United States Patent [19]

Ballard et al.

[11] 3,956,612

[45] May 11, 1976

[54] RADIANT HEATING MODULAR UNIT

[75] Inventors: Jules Ballard, Teaneck; Leonard D. Gigantino, Maplewood, both of N.J.

[73] Assignee: Irex Corporation, Riverdale, N.J.

[22] Filed: Oct. 4, 1974

[21] Appl. No.: 512,269

[52] U.S. Cl. ..... 219/358; 219/342; 219/351; 219/354; 219/388; 219/539; 219/541; 338/320

[51] Int. Cl.[2] ..... H05B 1/02; H05B 3/02; H01C 1/01

[58] Field of Search ..... 219/388, 405, 411, 339, 219/342, 343, 345, 347, 350–358, 541, 539; 338/320, 321, 319

[56] References Cited

UNITED STATES PATENTS

| | | | |
|---|---|---|---|
| 2,629,162 | 2/1953 | Peck | 219/388 X |
| 2,822,457 | 2/1958 | Hatch | 219/357 X |
| 2,857,499 | 10/1958 | Fearn | 219/354 X |
| 2,965,742 | 12/1960 | Joeckel | 219/351 |
| 3,257,542 | 6/1966 | Hultgreen | 219/352 |
| 3,471,682 | 10/1969 | Hisey et al. | 219/388 |
| 3,525,850 | 8/1970 | Hager | 219/357 |
| 3,649,808 | 3/1972 | Garbe | 219/388 X |
| 3,791,635 | 2/1974 | Schwestka | 236/15 B |

*Primary Examiner*—A. Bartis
*Attorney, Agent, or Firm*—Leo C. Krazinski

[57] ABSTRACT

A radiant heating modular array of rapid response radiant heating units includes a plurality of abutting heating element frame units in which the intermediate frame units have open sides and the end frame units have closed outer sides. Means on the front and back walls of the frame units support a plurality of thin foil radiant heating elements. Means including connectors of equal length interconnect the heating elements within each frame unit and from each of the abutting frame units to its contiguous unit whereby all of the heating elements are equally spaced laterally of the entire module to provide uniform heating and to avoid heat striation at the juncture of the units. The radiant heating module is controlled by electronic feedback circuitry including optical temperature sensors whereby the applied heat can be profiled to compensate for processing irregularities.

9 Claims, 6 Drawing Figures

RADIANT HEATING MODULAR UNIT

BACKGROUND OF THE INVENTION

1. Field of the Invention

The present invention relates to electrical heaters and, more particularly, to improved radiant heating modular units.

2. Description of Prior Art

Heretofore, individual heaters when butted together in a modular array to blanket the required material web width to the required temperature are incapable of maintaining a uniform temperature over every square inch of surface within tolerances of only a few degrees for the material to be acceptable. The basic construction and nature of the prior art heaters is such that the temperature falls off at the outer edges of the heating module. This is caused by (*a*) heating being lost through the metal case and (*b*) the geometry of the elements being such that, at best, the heating element is as far away from the metal casing as it is from an adjacent heating element. Consequently, when two heating modules are butted together in a multiple modular configuration, the unheated space between the heating elements of the adjacent heating modules is at least double that of the two adjacent heating elements in an individual heating module.

Accordingly, prior art heaters cannot be employed successfully with the heating elements arranged longitudinally in the machine direction for, as explained hereinabove, a heat striation pattern would be developed on the product passing underneath the area where two heaters are conventionally butted or interfaced. However, such prior art heaters can be used across the machine direction, but the useful width would be limited by the maximum length at which the heaters can be manufactured, based on the voltage, power requirements and watt density. Another drawback in the prior art heaters is that the heat pattern across the web cannot be "profiled" to compensate for other variables in the process, which variables are constantly affecting temperature uniformity. These usually are (*a*) temperature falling off at the extremities of the web because of conduction and natural convection; (*b*) variation in film thickness; (*c*) variation in web thickness; (*d*) a variation in the solvent or moisture content of the web; or (*e*) an unbalanced exhaust system.

SUMMARY OF THE INVENTION

Accordingly, an object of the present invention is to provide an improved modular array of radiant heaters which is not subject to the foregoing problems.

Another object is to provide an improved modular array of radiant heaters in which the heating elements are uniformly spaced, regardless of the number of modules assembled into the array, thereby accurately simulating an extremely large heater panel.

A further object is to provide a heating modular array in which the length or width of the modular array is no longer a physical limitation as to the size of the web to be processed.

Yet another object is to provide feed-back circuitry for profiling power to the heating elements of the modules.

A still further object is to accomplish the foregoing objects in a simple, practical and economical manner.

Other and further objects will be obvious upon an understanding of the illustrative embodiment about to be described, or will be indicated in the appended claims and various advantages not referred to herein will occur to one skilled in the art upon employment of the invention in practice.

In accordance with the present invention, the foregoing objects are generally accomplished by providing modular units in which the heating elements assembled therein are equally spaced across joined modules. To accomplish such element spacing the intermediate modules are laterally open, that is, no sides are provided at their junctions, while the end modules have closed sides only at their extreme ends, the inner sides being open to the intermediate modules.

Also, feed-back controls are provided for accurately profiling the applied temperature gradient across each square inch of a moving web to maintain absolute uniformity for the section of web being processed.

BRIEF DESCRIPTION OF THE DRAWINGS

A preferred embodiment of the invention has been chosen for purposes of illustration and description and is shown in the accompanying drawings, forming a part of the specification, wherein.

Figure 1:
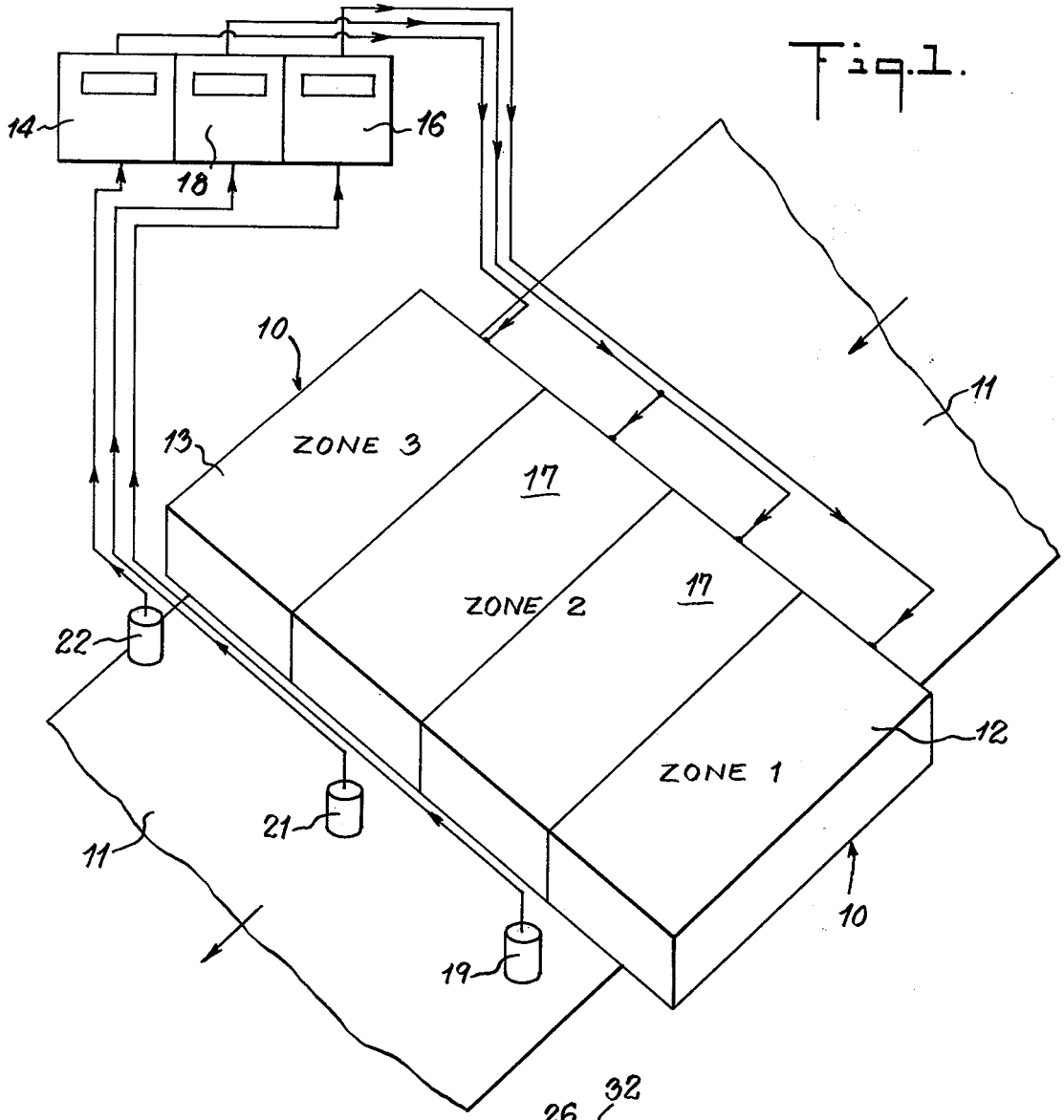
FIG. 1 is a schematic view in perspective of the modular array of radiant heating units.

Referring now to the drawings in detail, particularly FIG. 1, there is shown schematically a modular array of radiant heating units 10, four such units 10 in contiguous relationship, abreast of each other. In this instance the four units are shown heating a web 11 of material moving under the units in the direction of the arrow. As is conventional, the temperature of each of the units is controlled, the four units being decentralized into zones, zones 1 and 3 covering the end units 12, 13 under controllers 14 and 16, respectively, and zone 2 covering the two intermediate units 17 under controller 18 with web temperature sensors 19, 21, 22, respectively, on the downstream side of the units. The optical temperature sensors provide a feedback of the web temperature to the controllers which in turn increase or decrease the power to the heating units so as to maintain a constant pre-set web temperature. Feed-back controls per se are well known, but their use with moving webs, particularly fast moving webs, has not been applicable heretofore because of the slow response of high residual heat of conventional heaters. With the thin foil heating elements (U.S. Pat. No. 3,525,850) temperatures can respond rapidly and follow the fluctuations in the feed-back signals. In the present arrangement the sensors used are Land compensated radiation thermometers while the controllers comprise an amplifier (not shown) connected at its input to the sensor and at the latter's outputs to an indicating pyrometer (not shown) and control pyrometer (not shown), the output of the latter pyrometer being connected to an SCR Power Controller (not shown) and the latter's output in turn to the heating unit.

Figure 2:
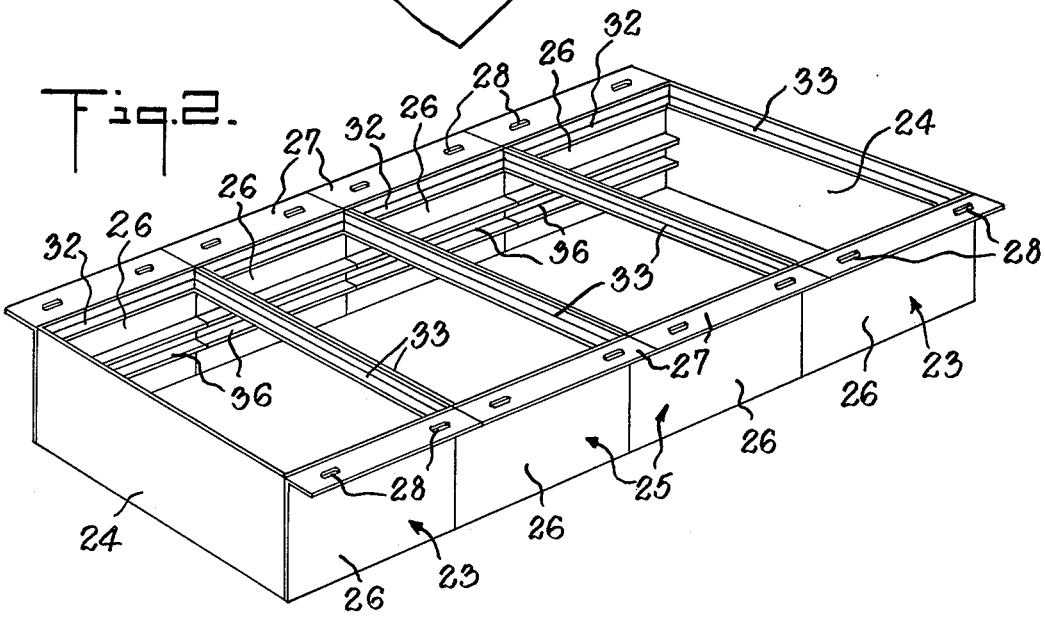
FIG. 2 is a perspective view of the modular framework showing closed outer sides for the right and left end units and open sides for the inner contiguous units.
Figure 6:
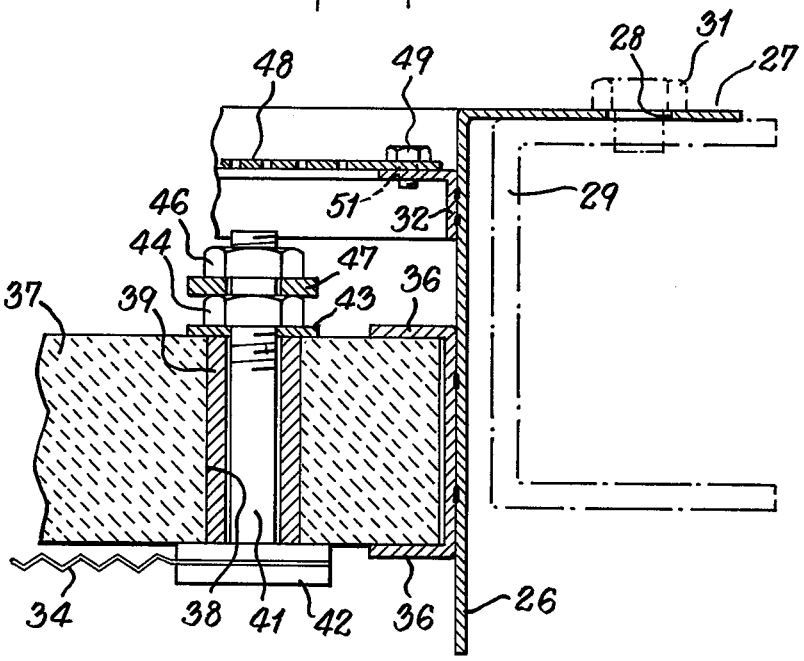
FIG. 6 is a sectional view on an enlarged scale, taken along the line 6—6 on FIG. 4, and showing the framework and elements in greater detail.

In FIG. 2 there are shown four casings which are part of the four heating units 12, 13, 17 and 17 schematically shown in FIG. 1. Each of the two end casings 23 includes an outer side member 24 and each of the casings 23, 25, referring now to FIG. 6 also, includes a front and rear wall 26, as viewed in FIG. 2, with a flange 27 at each of the upper ends. Spaced slotted openings 28 are provided for securing the casings to a supporting structure 29, as by bolts 31. Both walls 26 of each casing are rigidly secured together by reinforcing angular members 32, 33, as by welds, to provide a rectangular peripheral outline at the upper portion of the casing. For carrying appropriate radiant heating elements 34, such as disclosed in U.S. Pat. No. 3,525,850 of Aug. 25, 1970, channels 36 are welded to each of the walls 26 intermediate the top and bottom of each, each channel being opposite the other and extending the entire width of the wall 26. For supporting each heating element 34 there is shown (FIG. 6) a thermally insulating member 37, of such thickness as to slidably fit within webs of the opposing channels 36. Adjacent each end of member 37 is provided an opening 38 in which is disposed a sleeve 39 and within the sleeve 39 a bolt 41 at the head 42 of which is shown attached one end of the heating element 34. A washer 43 is mounted adjacent the end of the bolt 41 against the sleeve 39 and a nut 44 secures the washer 43 to the sleeve. Between nut 44 and another nut 46 there is shown a connector 47 for linking adjacent heating elements 34 in electrical continuity, the nut 46 securing the connector to the bolt 41. A perforated cover 48 for the casing is secured to the angular members 32 by bolts 49 inserted into threaded openings 51 of the members 32.

Figure 3:
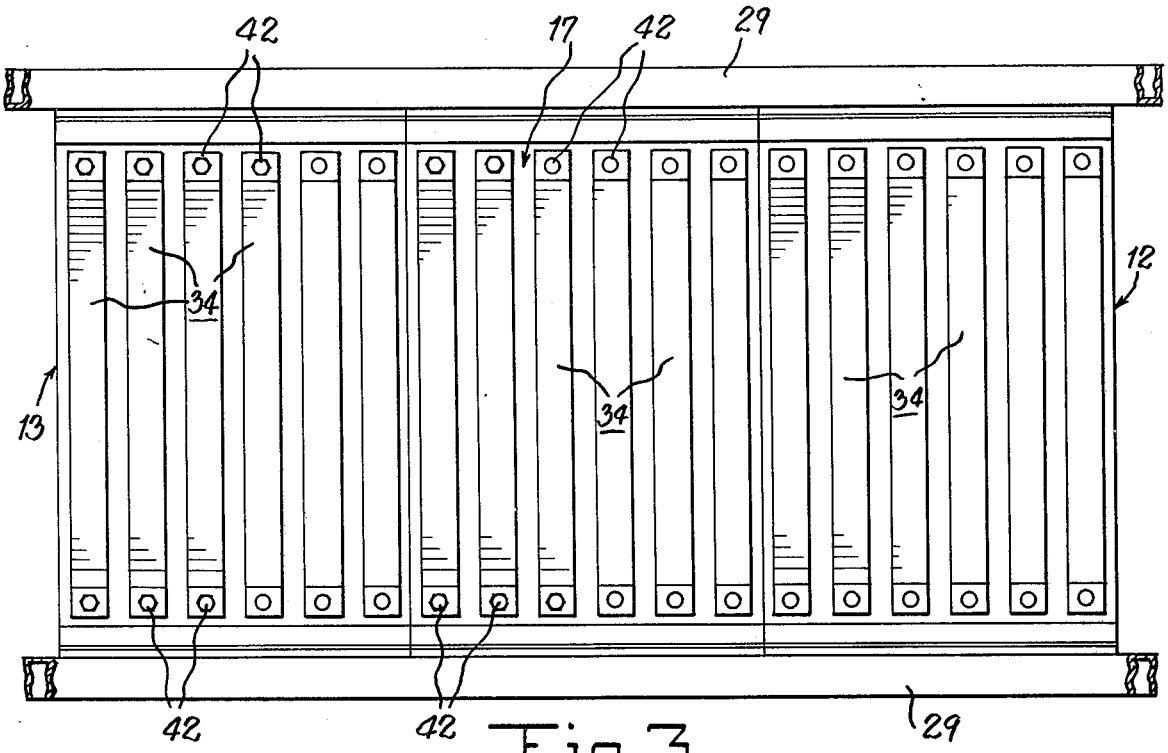
FIG. 3 is a bottom plan view of the modular framework shown in FIG. 2 with the heating elements assembled thereto.
Figure 4:
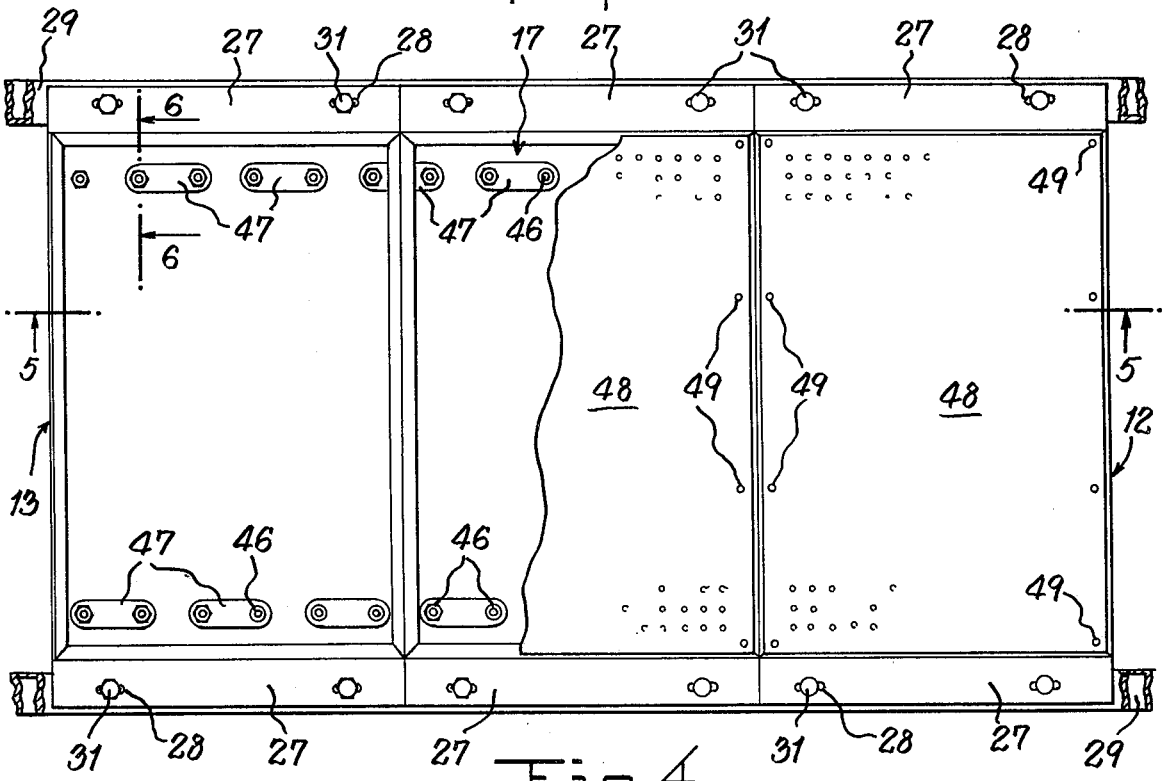
FIG. 4 is a top plan view of the modular framework shown in FIG. 3, partly broken away to show the heating element interconnections.
Figure 5:
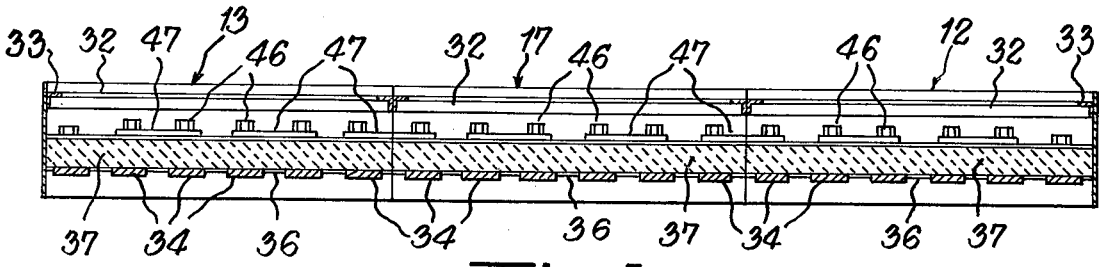
FIG. 5 is a sectional view taken along the line 5—5 on FIG. 4.

In FIGS. 3, 4 and 5 are shown three modular heating units 12, 13 and 17, rather than the four units shown in FIGS. 1 and 2, in order to save drawing space. In this instance only one intermediate unit 17 and two end units 12 and 13 are shown but they exemplify clearly the invention disclosed herein. It is to be noted that each heating unit carries six heating elements 34 and that the heating elements are not only equally spaced within each unit but the heating elements 34 of contiguous units are also equally spaced, as evidenced by the fact that the same connector 47 interconnects all heating elements 34 in the three unit arrangement. As shown, the heating elements 34 are electrically connected in series by the connectors 47 with power supply leads (not shown) furnishing the necessary energy to the heating elements.

From the foregoing description, it will be seen that by the use of the modular casings of this invention heating elements, carried thereby, are equally spaced, regardless of the number of contiguous casings or modules employed, to produce a uniform temperature over every square inch of surface within tolerances of only a few degrees for the product to be acceptable. Products requiring such close tolerances are webs (paper, textile, etc.) or coated substrates (hardboard, plywood, paper, etc.) of any considerable width which require heat-setting, drying, solvent removal, resin curing or a specific moisture content. A few of the advantages obtainable by use of the present invention are:

a. The open ended configuration allows the heating element spacing to be uniform regardless of the number of modules assembled into one heater array (eliminates striation between modules).

b. The length or width of the heater modular assembly is no longer a physical limitation on the size of the web to be processed.

c. The open-ended configuration allows the elements to be mounted in the machine direction, thus lending itself to controlling the temperature profile across the web.

This could be simple zoning for products requiring control of edge temperatures; but where extremely tight control is essential, a multiple feed-back loop can actually divide the width across the web into as many zones as required up to and including a control on each heater element (an extreme which is rarely ever required).

Heatsetting of fabrics and control of the moisture content of paper, curing vinyl sponge and curing catalyzed finishes are only a few of the processing areas that require an extremely uniform temperature across the web.

d. An additional benefit derived by use of the new modular construction is that the elements of the heaters can be so designed, the element connections so wired and the heaters electrically interconnected, so that the resultant size, length and width of the heater is almost without limitation (other than the available source of power).

As various changes may be made in the form, construction and arrangement of the parts herein, without departing from the spirit and scope of the invention and without sacrificing any of its advantages, it is to be understood that all matters are to be interpreted as illustrative and not in any limiting sense.

What is claimed is:

1. A radiant heating module for processing web material comprising a plurality of radiant heating elements, a plurality of laterally abutting frame units for carrying said radiant heating elements, means for joining said frame units into a single heating module having an end unit at each end of the module, each of said frame units including a front wall and a back wall with the sides of the units being open, means on said front and back walls for supporting said heating elements, an outer side member for closing the outer side of each of said end frame units, and means including connectors of equal length for interconnecting said heating elements within each of said frame units and from each of said abutting frame units to its contiguous unit, whereby all of said heating elements are equally spaced laterally throughout the entire module of frame units.

2. A radiant heating module according to claim 1, wherein each of said frame units includes angular members disposed around the periphery thereof and secured at their corners to form a rigid structure.

3. A radiant heating module according to claim 2, wherein said angular members of said frame units at frame unit junctures are secured together by said frame unit joining means, whereby an open space is provided between said joined units.

4. A radiant heating module according to claim 3, wherein said heating element supporting means include opposing channels on said front and back walls, all of said channels being in lateral alignment for ready insertion and removal of said heating element supporting means, following removal of one of said frame units from said frame unit joining means.

5. A radiant heating module according to claim 4, wherein each of said front and back walls includes a flange for attachment to a supporting structure.

6. A radiant heating module according to claim 5, wherein said heating element interconnecting means include studs at the ends of each heating element and a conducting element for securement to an adjacent pair of said heating element studs.

7. A radiant heating module according to claim 1, wherein said heating elements are of thin foil with rapid response to temperature changes.

8. A radiant heating module according to claim 7, wherein a power supply is provided for said heating elements, said power supply including feed-back controls for varying the temperature of each of the heating units so as to maintain a constant pre-set temperature profile across said web material.

9. A radiant heating module according to claim 8, wherein said feed-back controls include an optical temperature sensor at each of said units.

* * * * *